US007090056B2

(12) United States Patent
Fujita et al.

(10) Patent No.: US 7,090,056 B2
(45) Date of Patent: Aug. 15, 2006

(54) DOUBLE DECK ELEVATOR THAT CONTROLS A VELOCITY CHANGE DURING INTER-CAGE DISTANCE ADJUSTMENT

(75) Inventors: Yoshiaki Fujita, Tokyo (JP); Masakatsu Okamoto, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 334 days.

(21) Appl. No.: 10/479,514

(22) PCT Filed: Apr. 10, 2003

(86) PCT No.: PCT/JP03/04573

§ 371 (c)(1),
(2), (4) Date: Dec. 10, 2003

(87) PCT Pub. No.: WO03/086932

PCT Pub. Date: Oct. 23, 2003

(65) Prior Publication Data

US 2004/0238287 A1 Dec. 2, 2004

(30) Foreign Application Priority Data

Apr. 12, 2002 (JP) ..... 2002-111100

(51) Int. Cl.
*B66B 1/16* (2006.01)
*B66B 1/24* (2006.01)

(52) U.S. Cl. ..... 187/380; 187/902; 187/293

(58) Field of Classification Search ..... 187/277, 187/291, 393, 394, 902, 284, 380–388, 391, 187/293

See application file for complete search history.

(56) References Cited

U.S. PATENT DOCUMENTS 6,161,652 A * 12/2000 Kostka et al. ..... 187/291
6,334,511 B1 1/2002 Araki
6,336,522 B1 * 1/2002 Fujita et al. ..... 187/380
6,786,305 B1 * 9/2004 Kamimura et al. ..... 187/314
6,802,396 B1 * 10/2004 Naitoh ..... 187/401

* cited by examiner

*Primary Examiner*—Jonathan Salata
(74) *Attorney, Agent, or Firm*—Oblon, Spivak, McClelland, Maier & Neustadt, P.C.

(57) ABSTRACT

A double deck elevator including a winding machine which lifts up/down a cage frame loaded with two cages in a vertical direction, a cage driving unit which changes a relative distance between upper and lower cages, and a cage position controller which starts an inter-cage distance adjustment operation of the cage driving unit almost at the same time when the winding machine is shifted from an acceleration operation to a constant velocity operation, and changes an operating velocity of the inter-cage distance adjustment operation corresponding to a destination floor almost at the same time when the winding machine changes from the constant velocity operation to a deceleration operation after the destination floor is determined, whereby completing the inter-cage distance adjustment operation almost at the same time when the winding machine stops.

14 Claims, 5 Drawing Sheets

DOUBLE DECK ELEVATOR THAT CONTROLS A VELOCITY CHANGE DURING INTER-CAGE DISTANCE ADJUSTMENT

TECHNICAL FIELD

The present invention relates to a double deck elevator in which two cages are connected vertically and more particularly to a double deck elevator having an inter-cage distance adjusting mechanism capable of adjusting a gap between the cages during elevator operation.

BACKGROUND ART

In a high-rise building or the like, the double deck elevator in which two cages are constructed vertically on two stages have been utilized as traffic means for vertical traffic in the building in order to improve space efficiency of the building. In this kind of the double deck elevator as shown in FIG. 1, a type having an inter-cage distance adjusting mechanism for adjusting the distance between the cages by moving the upper and lower cages 2, 4 within a cage frame 1 to opposite directions by using a crank mechanism 7 has been well known. In the type shown in FIG. 1, the upper cage 2 and the lower cage 4 are installed on the crank mechanism 7 mounted on the central portion of the cage frame 1 and the upper cage 2 and the lower cage 4 are driven to opposite directions by means of a motor 8 and ball screws 9 in a state in which they are balanced by their own weights. In another type, while one of vertically arranged cages is stationary, the other cage is movable so as to adjust the distance between the cages.

Because in the double deck elevator having the inter-cage distance adjusting mechanism, that adjustment operation is carried out during elevator operation, passengers in the cage may feel anxious or discomfort.

Conventionally, as a method for solving such a problem, the one described in Jpn. Pat. Appln. KOKAI Publication No. 2001-302115 has been well known. According to this publication, a cage driving unit is controlled such that at the same time when a destination floor is determined and a winding machine (elevator) begins to decelerate, the inter-cage distance adjusting operation starts and that adjusting operation is completed during elevator deceleration.

FIG. 2 shows an operation pattern of the winding machine and the cage driving unit proposed in the same publication. Here, a double deck elevator in which the upper and lower cages are driven to opposite directions at the same time is assumed. Curve S1 indicates an operation velocity pattern of the winding machine (that is, a velocity change of the cage frame of the elevator), curve S2 indicates the velocity change of one cage driven in the elevator advancement direction, curve S2' indicates the velocity change of the other cage driven to an opposite direction to the elevator advancement direction and curve S3 indicates an operation velocity pattern of the cage driving unit. The velocity change S2 of one cage is expressed as S1+S3, while the velocity change S2' of the other cage is expressed as S1−S3.

Usually, the elevator accelerates at a specific acceleration from a startup floor with a driving of the winding machine and then enters a constant velocity operation. After the destination floor is determined, a deceleration operation starts at time t1, a specified deceleration is maintained in an interval between time t2 and time t3 and then, deceleration is lowered from time t3 until time t4 at which the elevator stops with the safety. Then, the elevator stops. The cage driving unit is controlled according to an operation pattern in the elevator deceleration period so as to adjust the distance between the cages.

The reason why the cage adjustment operation is carried out during elevator deceleration is that if it is executed in other period than the deceleration period, no destination floor is determined so that how long the distance between the cages should be secured is not known (the distance being dependent on destination floors) and if the inter-cage distance adjustment is carried out in the period of the elevator constant velocity moving, a velocity change by the adjustment operation is transmitted directly to passengers. If the inter-cage distance adjustment is carried out according to an operation pattern during elevator deceleration as shown in FIG. 2, the upper and lower cages turn into a velocity pattern of constant acceleration, low velocity and constant deceleration, so that passengers in the cage hardly feel a velocity change by the adjustment operation.

However, according to the conventional method in which as described above, the distance between the cages is adjusted in the deceleration period from startup of the elevator deceleration until elevator stop, the velocity change at the time of the adjustment operation is large if the adjustment distance between the cages is large or the elevator deceleration period is short. That is, because the distance between the cages needs to be adjusted corresponding to a destination floor in a short time in the deceleration period, the velocity change between t1 and t2 shown in FIG. 2 is increased and the velocity change provides the passengers with a feeling of disharmony so that they feel discomfort.

Further, a large capacity cage driving unit is necessary to adjust the distance between the cages in a short time in the deceleration period, thereby leading to increased cost in equipment.

DISCLOSURE OF INVENTION

The present invention is directed to substantially obviates one or more of the problems due to limitations and disadvantages of the related art and therefore an object of the invention is to provide a double deck elevator which can be operated without making passengers feel disharmony by suppressing a velocity change generated at the time of inter-cage distance adjustment and enables an inter-cage distance adjusting mechanism to be driven by a small capacity driving system.

BEST MODE FOR CARRYING OUT THE INVENTION

Hereinafter, embodiments of the present invention will be described with reference to the accompanying drawings.

FIRST EMBODIMENT

Figure 3:
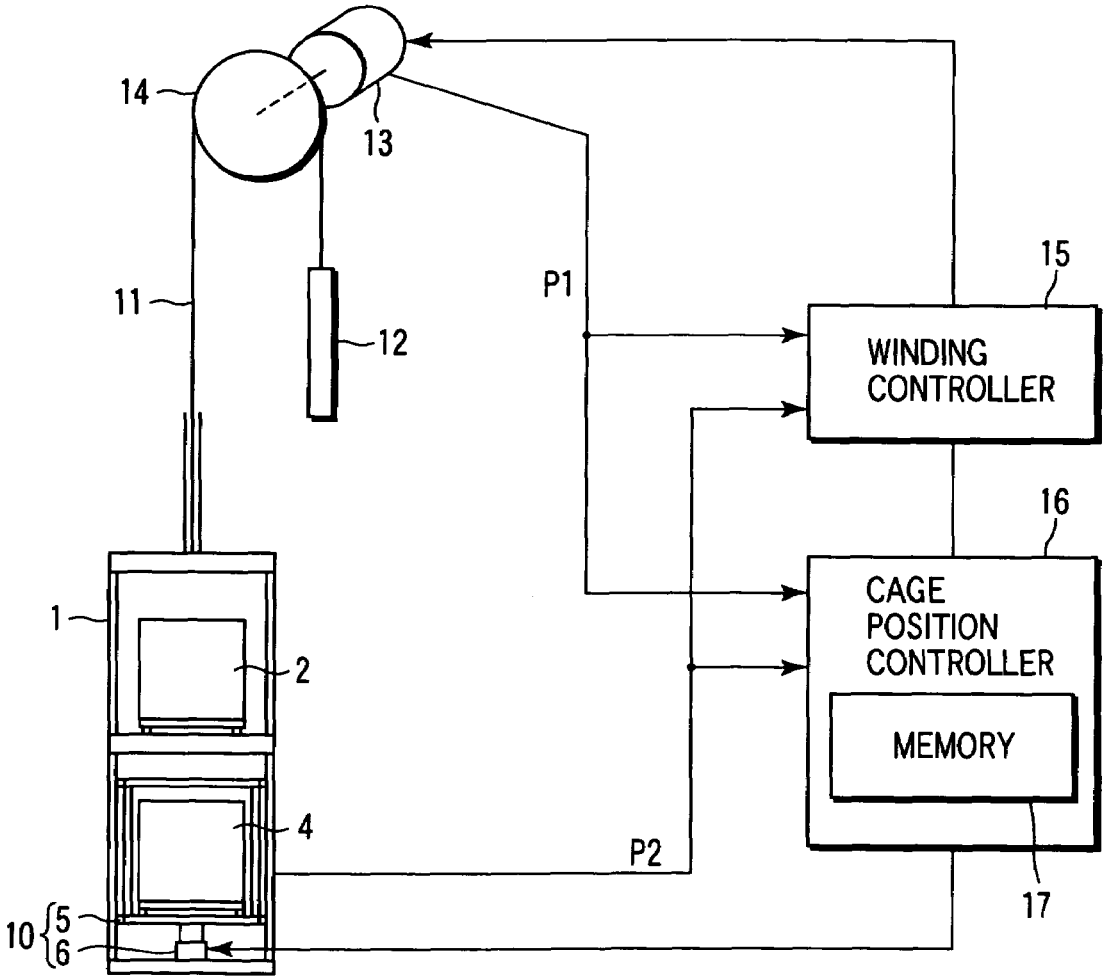
FIG. 3 is a diagram showing the configuration of a double deck elevator according to a first embodiment of the present invention.

FIG. 3 is a diagram showing the configuration of a double deck elevator according to a first embodiment of the present invention. The elevator comprises a cage frame 1, and upper and lower cages 2 and 3 provided within the cage frame 1.

The upper cage 2 and the lower cage 4 are mounted on the cage frame 1 and either or both of the upper cage 2 and the lower cage 4 are provided with a cage driving unit 10. In FIG. 3, the lower cage 4 is provided with the cage driving unit 10, for example. The cage driving unit 10 comprises a guide roller 5 and an actuator 6. If the actuator 6 of this cage driving unit 10 is driven, the lower cage 4 is moved up/down through the guide roller 5 so that the distance between the upper cage 2 and the lower cage 4 is changed. Hereinafter, the cage to be driven by this cage driving unit 10 is referred to as "moving cage." According to the present invention, the configuration of the cage driving unit 10 is not restricted to any particular one.

The cage frame 1 loaded with the upper cage 2 and the lower cage 4 is connected to a counter weight 12 through a rope 11 wound around a sheave 14 provided on a motor shaft of a winding machine 13. With a rotation of the sheave 14 driven by the winding machine 13, the cage frame 1 is lifted up/down to an opposite direction vertically to and with the counter weight 12 like a well bucket. The winding machine 13 comprises a cage position detecting device (not shown) such as a pulse generator and a proximity switch, so that the position of the cage frame 1 is detected. A cage position signal P1 detected by the cage position detecting device is inputted to a winding controller 15 and a cage position detecting device 16.

A cage position signal P2 of the moving cage to be driven by the cage driving unit 10 is detected by a moving cage position detecting device (not shown) like the proximity switch, for example, and inputted to the winding controller 15 and the cage position controller 16.

The winding controller 15 controls driving of the winding machine 13 such that the cage accelerates at a constant acceleration according to the cage position signal P1 of the cage frame 1 and maintains its rated velocity and after a destination floor is determined, it decelerates at a constant deceleration and stops at the destination floor.

The cage position controller 16 has a memory 17 which stores inter-floor distance information corresponding to a floor height dimension of each floor. The cage position controller 16 controls the cage driving unit 10 so as to adjust a relative distance between the upper cage 2 and the lower cage 4 corresponding to the inter-floor distance of the destination floor based on the inter-floor distance information of the destination floor stored in this memory 17.

When the distance between the cages is adjusted during an elevator operation, the cage driving unit 10 operates as follows. The adjustment operation is not executed only in the deceleration period of the elevator (winding machine) unlike the conventional example, but the adjustment operation is carried out since a time when a constant velocity period starts from its acceleration period. In this case, because initially, no destination floor is determined, first, the adjustment operation is provisionally executed at predetermined velocity V1, and after the destination floor is determined, the operation velocity is changed from V1 to V2 and the cage driving unit 10 is controlled so as to adjust the distance between the upper and lower cages corresponding to the inter-floor distance of the destination floor.

The control operation will be described in detail with reference to FIG. 4.

Figure 1:
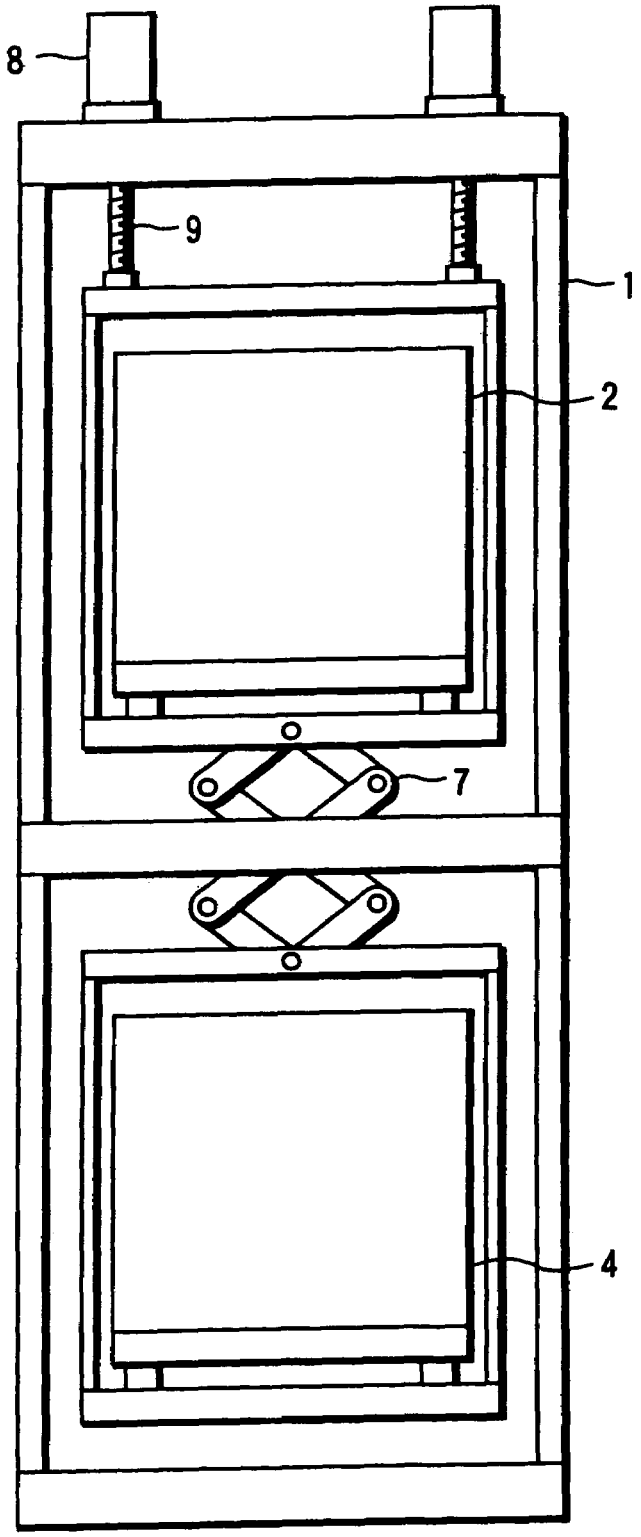
FIG. 1 Prior Art
FIG. 1 shows an example of an inter-cage distance adjusting mechanism capable of adjusting a distance between upper and lower cages in a double deck elevator.
Figure 2:
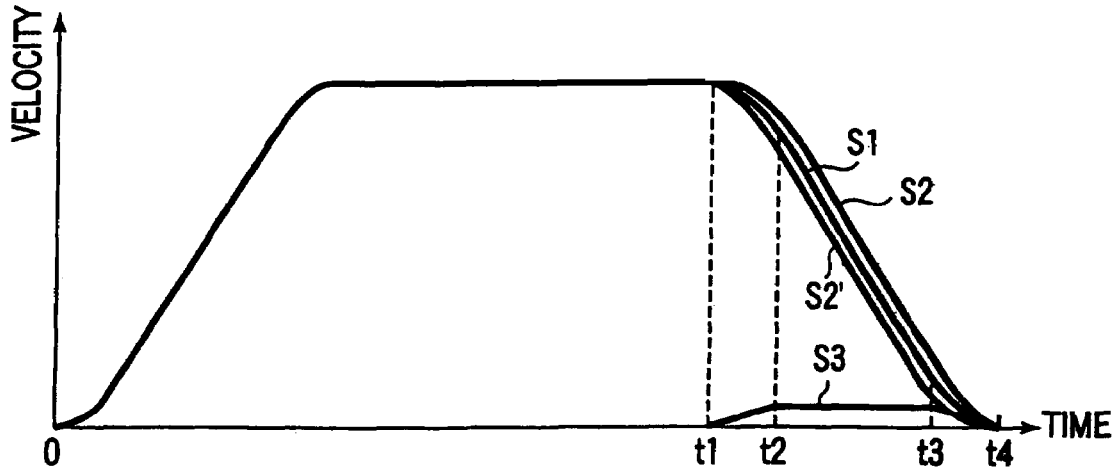
FIG. 2 Prior Art
FIG. 2 is a characteristic diagram showing an example of an operation velocity pattern at the time of inter-cage distance adjustment of the double deck elevator according to a conventional method.
Figure 4:
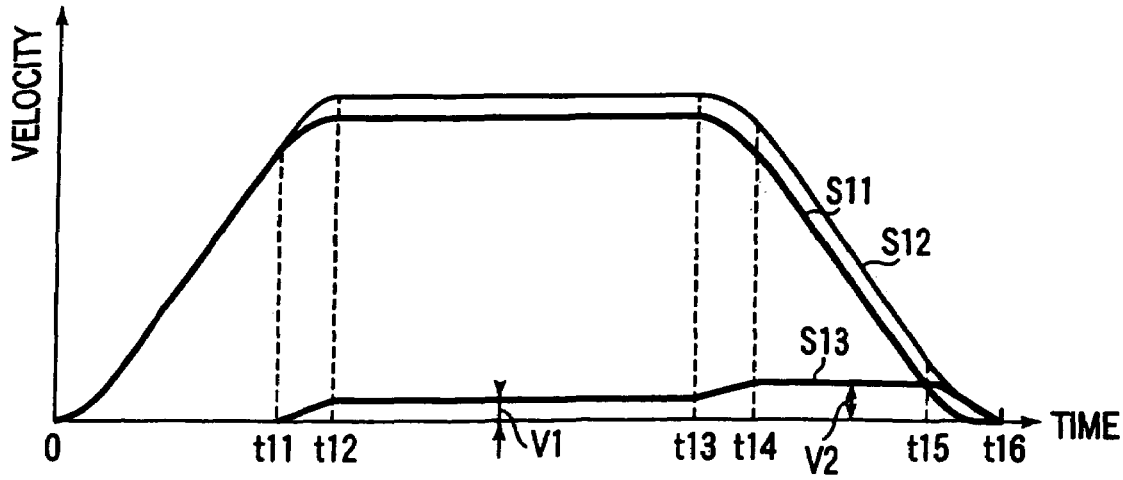
FIG. 4 is a characteristic view showing an example of an operation velocity pattern at the time of inter-cage distance adjustment of the double deck elevator according to the first embodiment.

FIG. 4 is a characteristic view showing an example of the operation velocity pattern at the time of inter-cage distance adjustment of the double deck elevator according to the first embodiment of the present invention. This indicates an operation velocity pattern in case where the cage driving unit 10 is so constructed as to drive one cage (lower cage 4 here) in the direction of elevator advancement. Its ordinate axis indicates the velocity while the abscissa axis indicates time. Curve S11 indicates an operation velocity pattern of the winding machine (velocity change of the cage frame 1), curve S12 indicates a velocity change of the moving cage (lower cage 4) and curve S13 indicates an operation velocity pattern of the cage driving unit 10.

The winding machine 13 (speaking in detail, cage frame 1 which moves in an elevator path with the driving of the winding machine 13) is accelerated until a constant velocity is reached and at time t11, the acceleration stops and then, constant velocity operation starts at time t12. Then, if a destination floor of the cage frame 1 is determined, the deceleration operation starts at time t13 and a constant deceleration velocity is maintained between time t14 and time t15. Then, the deceleration stops in the period from time t15 until time t16 in which safety stop is achieved.

Here, the cage position controller 16 starts inter-cage distance adjustment operation in a period from time t11 to time t12 at which the winding machine 13 changes from its acceleration operation to a constant velocity operation, corresponding to an operation pattern of the winding machine 13 and controls the cage driving unit 10 so as to change a distance between the cages at a constant velocity V1 at time t12. When a destination floor of the cage frame 1 is determined and the winding machine 13 is changed from its constant velocity operation to deceleration operation, the cage position controller 16 calculates a velocity V2 such that the adjustment operation is completed at time t16 when the cage frame 1 stops at the destination floor. Then, the cage driving unit 10 is so controlled that, in a period from time t13 to time t14 when a predetermined deceleration velocity is reached, velocity change from velocity V1 to velocity V2 is completed and the inter-cage distance adjustment operation is completed in the period from time t15 to time t16.

The memory 17 stores information about the inter-floor distance of each floor and the cage position controller 16 obtains V1 and V2 as follows based on the information stored in the memory 17.

Velocity V1 is a temporary velocity until a destination floor is determined. At time t11 when the winding machine 13 is transferred from its acceleration operation to its constant velocity operation, the inter-floor distance information of a floor at which the cage frame 1 may stop is read out from the memory 17 and then, this velocity V1 is calculated based on an average of the inter-floor distance information, an average of a time until each stoppable floor is reached and further a distance between the cages at a current time.

Further, as for the velocity V2, at time t13 when the winding machine 13 is transferred from its constant velocity operation to its deceleration operation after a destination floor is determined, the inter-floor distance information of the destination floor is read out from the memory 17 and then, the velocity V2 is calculated based on the inter-floor distance information of that destination floor, a period of time from t13 to t16 (that is, time required after deceleration starts until a cage is stopped at the destination floor) and the distance between the cages at a current time.

If the cage driving unit 10 is controlled, one cage is moved so as to adjust the distance between the cages during an elevator operation. In this case, because the same operation pattern S11 as an ordinary elevator is adopted in the upper cage 2 which is a fixed side cage, passengers do not feel any disharmony due to a velocity change for the inter-cage distance adjustment. On the other hand, a velocity change S13 due to the inter-cage distance adjustment by the cage driving unit 10 is added to the velocity change of the lower cage 4, which is a moving side cage (S12=S11+S13). Because the inter-cage distance adjustment operation is carried out corresponding to the operation pattern S11 of the winding machine 13 at this time, passengers hardly feel disharmony so that riding comfort is not lost.

Because the inter-cage distance adjustment starts before the elevator enters its constant velocity operation, the adjustment time is prolonged and as compared to a conventional case of carrying out the adjustment operation only in the deceleration period, adjustment velocity necessary at that time can be reduced. Therefore, a small cage driving unit 10 can meet this demand thereby achieving reduction of the power supply capacity and the number of power supply cables. Further, there is such an advantage that with drop of the adjustment velocity, noise generated from the cage driving unit 10 can be reduced.

Figure 5:
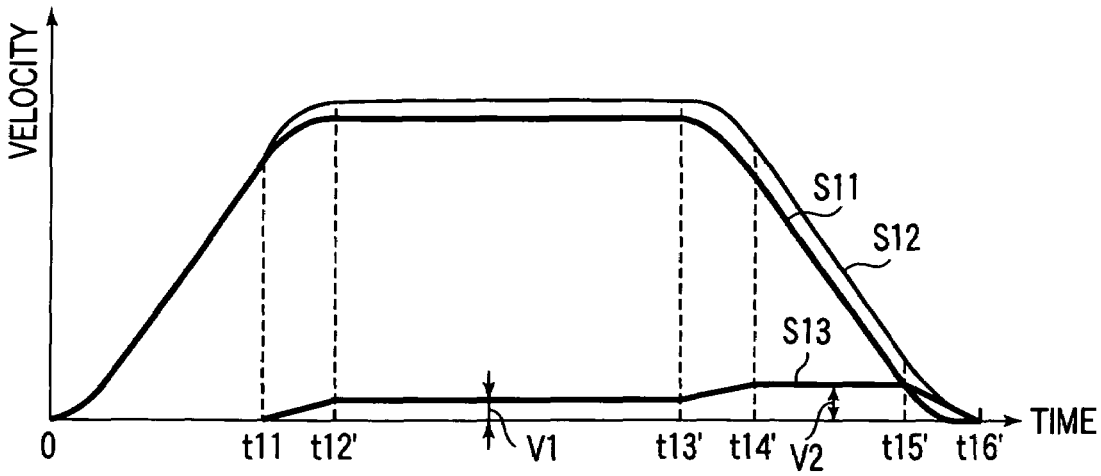
FIG. 5 is a characteristic view showing another example of the operation velocity pattern at the time of inter-cage distance adjustment of the double deck elevator according to the first embodiment.

FIG. 5 is a characteristic view showing another example of the operation velocity pattern at the time of inter-cage distance adjustment of the double deck elevator according to the first embodiment. According to this example, a time for acceleration change (t11–t12', t13'–t14', t15'–t16') is set long by controlling an acceleration change rate to be smaller than usually (when the inter-cage distance adjusting operation is not carried out) when the cage frame 1 (winding machine 13) changes from an acceleration operation to a constant velocity operation and when it changes from the constant velocity operation to the deceleration operation. Consequently, the acceleration change of the moving cage can be made smaller than the case of FIG. 4, so that passengers do not feel disharmony in the inter-cage distance adjustment operation.

Figure 6:
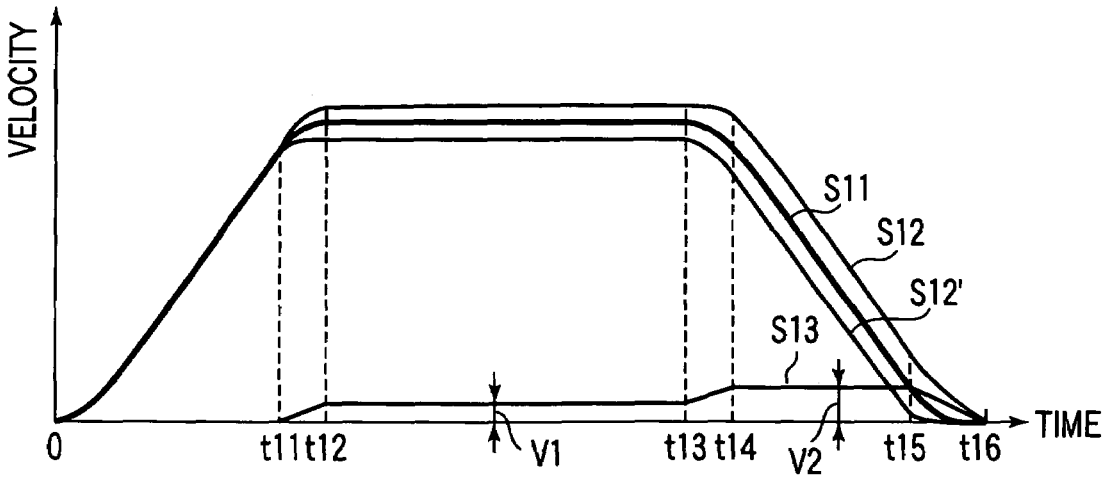
FIG. 6 is a characteristic view showing still another example of the operation velocity pattern at the time of inter-cage distance adjustment of the double deck elevator according to the first embodiment.

FIG. 6 is a characteristic view showing still another example of the operation velocity pattern at the time of inter-cage distance adjustment of the double deck elevator according to the first embodiment. This diagram shows an operation velocity pattern of a case where the cage driving unit 10 is so constructed to drive two cages (upper cage 2 and lower cage 4) to opposite directions to each other. The ordinate axis indicates the velocity while the abscissa axis indicates time. Curve S11 indicates the operation velocity pattern of the (velocity change of the cage frame 1) of the winding machine 1, curve S12 indicates a velocity change of one cage (lower cage 4) driven in the direction of the elevator advancement, curve S12' indicates a velocity change of the other cage (upper cage 2) driven in an opposite direction to the elevator advancement direction and curve S13 indicates an operation velocity pattern of the cage driving unit 10.

In case of a configuration in which two cages are driven in opposite directions at the same time, the same control as the case of a configuration in which only one cage is driven as described in FIG. 4 is carried out. That is, the cage driving unit 10 is controlled as follows. The cage position controller 16 starts its inter-cage distance adjustment operation in a period from time t11 to time t12 at which the winding machine 13 changes from its acceleration operation to a constant velocity operation, corresponding to an operation pattern of the winding machine 13 and controls the cage driving unit 10 so as to change a distance between the cages at a constant velocity V1 at time t12. When a destination floor of the cage frame 1 is determined and the winding machine 13 is changed from its constant velocity operation to deceleration operation, the cage position controller 16 calculates a velocity V2 such that the adjustment operation is completed at time t16 when the cage frame 1 stops at the destination floor. Then, the cage driving unit 10 is so controlled that, in a period from time t13 to time t14 when a predetermined deceleration velocity is reached, velocity change from velocity V1 to velocity V2 is completed and the inter-cage distance adjustment operation is completed in the period from time t15 to time t16.

If the cage driving unit 10 is controlled in this way, the upper and lower cages are moved during elevator operation so as to adjust the distance between the cages. In this case, a velocity change S13 for the inter-cage distance adjustment is applied to each of the moving cage (lower cage 4) driven in the advancement direction of the cage driving unit 10 and the moving cage (upper cage 2) driven in an opposite direction to the elevator advancement direction (S12=S11+S13, S12'=S11−S13). Because the inter-cage distance adjustment operation is carried out corresponding to the operation pattern S11 of the winding machine 13 like the case of FIG. 4, passengers in both the cages hardly feel disharmony so that a riding comfort is not lost.

Further, because the inter-cage distance adjustment time is set longer than the conventional method like the case of FIG. 4, the adjustment velocity can be reduced, thereby achieving reductions in the power supply capacity of the cage driving unit 10, the number of power supply cables and noise generated from the cage driving unit 10.

According to the first embodiment, inter-floor distance information of each floor is stored in the memory 17 and the cage position controller 16 reads out the inter-floor distance information relating to the destination floor from the memory 17 so as to obtain the operation velocities V1, V2 of the cage driving unit 10. Alternatively, it is permissible to have such a configuration in which V1 and V2 are calculated for every combination allowing the elevator to operate between respective floors of a building (that is, every pattern which allows the cage frame 1 to operate between the respective floors) and the calculation results are stored in the memory 17 as a data table. Consequently, even if the V1 and V2 are not calculated, the cage driving unit 10 can be controlled by reading out data about V1 and V2 from the memory 17, thereby reducing a load on processing in the cage position controller 16.

According to the first embodiment of the present invention, a double deck elevator comprises:

a winding machine which lifts up/down a cage frame loaded with two cages in a vertical direction;

a cage driving unit which changes a relative distance between upper and lower cages; and a cage position controller which starts an inter-cage distance adjustment operation of the cage driving unit almost at the same time when the winding machine is shifted from an acceleration operation to a constant velocity operation, and changes an operating velocity of the inter-cage distance adjustment operation corresponding to a destination floor almost at the same time when the winding machine changes from the constant velocity operation to a deceleration operation after the destination floor is determined, whereby completing the inter-cage distance adjustment operation almost at the same time when the winding machine stops.

As described above, almost at the same time when the winding machine changes from the acceleration operation to the constant velocity operation, the inter-cage adjustment operation is started and almost at the same time when the winding machine changes from the constant velocity operation to the deceleration operation, the operating velocity of the inter-cage adjustment operation is changed corresponding to a destination floor. Then, almost at the same time when the winding machine stops at the destination floor, the inter-cage adjustment operation is completed. Because the inter-cage adjustment operation is carried out corresponding to the operation pattern of the elevator (winding machine) comprised of acceleration, constant velocity operation and deceleration, even if a velocity change due to inter-cage adjustment is applied at the time of elevator operation, passengers do not feel disharmony. Further, if the adjustment time is prolonged by executing the inter-cage adjustment operation early in the elevator acceleration period, the adjustment velocity can be dropped. Therefore, even a small capacity driving system can cope with this embodiment.

According to the first embodiment of the present invention, a double deck elevator comprises:

a winding machine which lifts up/down a cage frame loaded with two cages in a vertical direction;

a cage driving unit which changes a relative distance between upper and lower cages; and a cage position controller which starts an inter-cage distance adjustment operation of the cage driving unit almost at the same time when the winding machine is shifted from an acceleration operation to a constant velocity operation, and keep an operating velocity of an inter-cage distance adjustment operation at a first velocity V1 when the winding machine is set to the constant velocity operation, and changes the operating velocity of the inter-cage distance adjustment operation at a second velocity V2 almost at the same time when the winding machine changes from the constant velocity operation to a deceleration operation after a destination floor is determined, whereby completing the inter-cage distance adjustment operation almost at the same time when the winding machine stops.

As described above, almost at the same time when the winding machine changes from the acceleration operation to the constant velocity operation, the inter-cage adjustment operation is started and when the winding machine enters into the constant velocity, the cage adjustment is carried out at the velocity V1. When the winding machine enters into deceleration operation after a destination floor is determined, the cage adjustment is carried out at the velocity V2. Because the cage position adjusting unit drives the cage driving unit at the velocity V1 while the winding machine is run at a constant velocity, the velocity generated in the cage becomes constant and while the winding machine is decelerated at a constant velocity also, the cage position adjusting unit drives the cage driving unit at the velocity V2. Consequently, deceleration velocity generated in the cage becomes constant. Therefore, when the elevator is run, it can be operated without making passengers feel disharmony even if the cage adjustment is carried out. Further, the adjustment velocity can be lowered by executing the inter-cage adjustment operation early in the elevator acceleration period so as to decrease the adjustment velocity, so that even a small capacity driving system can cope with this embodiment.

The double deck elevator may further comprises a memory which stores inter-floor distance information of each floor of a building. The cage position controller may read out the inter-floor distance information of each stoppable floor from the memory which the cage frame may stop when the winding machine is shifted from the acceleration operation to the constant velocity operation, and calculate the first velocity V1 based on an average of the inter-floor distance information and an average of a time taken until the elevator reaches each stoppable floor.

The velocity V1 is calculated using the inter-floor distance information stored in the memory. Because in this case, any destination floor is not determined until the winding machine enters deceleration operation, the velocity V1 is calculated based on the average of the inter-floor distance information of each floor which the cage frame may reach and the average of the time taken until it reaches each floor.

The double deck elevator may further comprise a memory which stores inter-floor distance information of each floor of a building. The cage position controller may read out the inter-floor distance information of each floor from the memory which the cage frame may stop when the winding machine is shifted from the acceleration operation to the constant velocity operation, and calculate the second velocity V2 based on inter-floor distance information corresponding to the destination floor and a time taken until the elevator reaches the destination floor.

The velocity V2 is calculated based on the inter-floor distance information stored in the memory. In this case because a destination floor is determined when the winding machine enters into the deceleration operation, the velocity V2 is calculated based on the inter-floor distance information corresponding to the destination floor and the time taken until the cage frame stops at the destination floor.

The double deck elevator may further comprise a memory which stores the first velocity V1 and the second velocity V2 for each operation pattern of the cage frame as data table. The cage position controller may read out the first velocity V1 and the second velocity V2 corresponding to a departure floor and the destination floor of the cage frame so as to control the cage driving unit.

The velocities V1, V2 are not calculated at the time of elevator operation, but the velocities V1, V2 corresponding to the departure floor and destination floor are read out from the memory so as to perform the control.

The cage position controller may accelerate the operating velocity of the inter-cage distance adjustment operation unit to the velocity V1 until the winding machine is shifted from the acceleration operation to the constant velocity operation, and after the destination floor is determined, change the velocity from V1 to V2 while the winding machine is shifted from the constant velocity operation to the deceleration operation.

A timing of the velocity change of the cage driving unit overlaps a timing of an acceleration change of the winding machine and therefore, passengers in the cage never feel disharmony due to that acceleration change.

The winding machine may control an acceleration change rate when the winding machine changes from the acceleration operation to the constant velocity operation and from the constant velocity operation to the deceleration operation to be smaller than a case where the cage driving unit does not perform the inter-cage distance adjustment operation.

The operating velocity of the cage driving unit is changed at the same timing as a timing in which the winding machine changes from the acceleration operation to the constant velocity operation or from the constant velocity operation to the deceleration operation. If the acceleration change rate of the winding machine is set smaller than usually at that time, an influence of acceleration at the time of inter-cage adjustment upon passengers in the cage can be reduced.

The cage driving unit may drive one of the upper and lower cages relative to another of the upper and lower cages.

The winding machine is operated so as to settle a cage on the side which is not driven by the cage driving unit on a destination floor and the cage driving unit is operated such that the distance between the upper and lower cages becomes similar to a dimension of a floor height of a destination floor.

The cage driving unit may drive both of the upper and lower cages.

The winding machine is operated so as to stop the cage frame in the middle of the second floor of a destination floor.

SECOND EMBODIMENT

A second embodiment of the present invention will be described.

Figure 7:
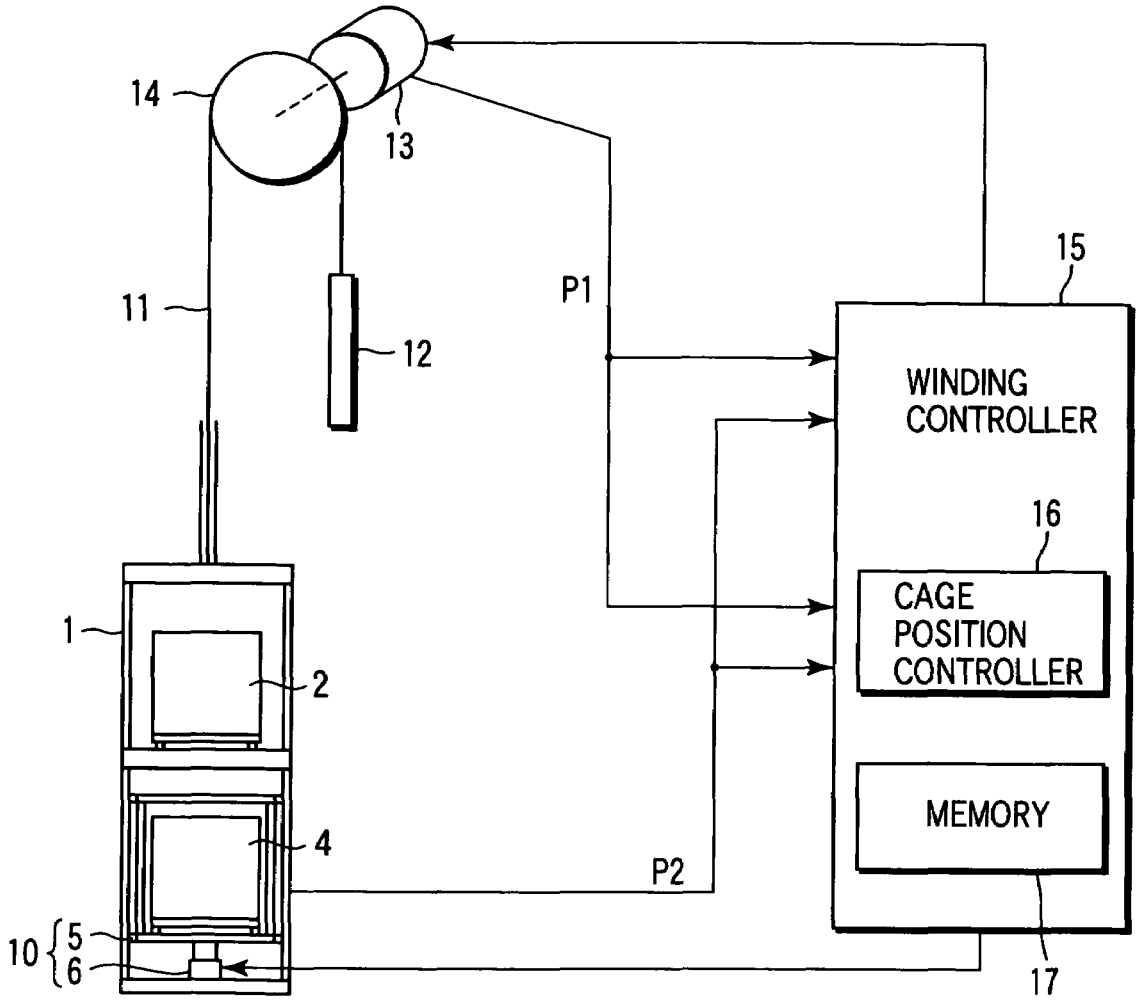
FIG. 7 is a diagram showing the configuration of a double deck elevator according to a second embodiment of the present invention.

FIG. 7 is a diagram showing the configuration of a double deck elevator according to the second embodiment of the present invention. In the second embodiment, the cage position controller 16 and the memory 17 are incorporated in the winding controller 15 as compared to the configuration of the first embodiment (FIG. 3).

In other words, the winding controller 15 incorporates the cage position controller 16 and the memory 17 and the winding controller 15 issues a control instruction to the winding machine 13 and a control instruction to the cage driving unit 10. The memory 17 stores data about V1 and V2 calculated based on the between-floor information of each floor or its between-floor information preliminarily.

With such a configuration, like the first embodiment, the cage driving unit 10 is controlled as follows. The winding controller 15 starts the adjustment operation almost at the same time when the winding machine 13 is shifted from its acceleration operation to the constant velocity operation. The operation velocity is changed from V1 to V2 at the same time when the constant velocity operation is changed to the deceleration operation and almost at the same time when the winding machine stops, the adjustment operation is completed. In this case, the operation pattern shown in FIG. 4 is adopted if the cage driving unit 10 drives one cage, while if it drives both the cages to opposite directions, the operation pattern shown in FIG. 6 is adopted.

Even if the winding controller 15 incorporates the cage position controller 16 and the memory 17 as shown in FIG. 7, the same effect as the first embodiment is obtained.

Under the configuration shown in FIG. 7, a control signal is output from the winding controller 15 incorporated in an elevator machine room to the cage driving unit 10 through a tail cord (not shown) and therefore, the number of the cables of the tail cord needs to be large. However, because the winding controller 15 and the cage position controller 16 can be integrated, transmission of information among the control units can be simplified and further, cost necessary for the control units can be reduced.

According to the second embodiment of the present invention, the cage position control unit is incorporated in the winding machine control unit. Thus, control information is shared by integrating the cage position control unit with the winding machine control unit.

According to the embodiments of the present invention, the cage is accelerated at a constant acceleration velocity, run at a constant velocity or decelerated at a constant deceleration velocity corresponding to the operation pattern of the elevator (winding machine), so that passengers do not feel disharmony in a velocity change generated by the inter-cage distance adjustment and can obtain the same feeling of traveling as an ordinary elevator. Because the inter-cage distance adjustment starts before the elevator (winding machine) enters the deceleration period, even if the adjustment distance between the cages is large or the elevator deceleration period is short, the velocity change at the time of the adjustment operation can be suppressed. Further, setting a long inter-cage distance adjustment time can decrease the adjustment velocity at that time. Thus, even a small capacity driving system can cope with this elevator system thereby achieving reductions in the size of the power supply, the number of power supply cables and generated noise.

The invention claimed is:

1. A double deck elevator comprising:

a winding machine which lifts up/down a cage frame loaded with two cages in a vertical direction;

a cage driving unit which changes a relative distance between upper and lower cages; and a cage position controller which starts an inter-cage distance adjustment operation of the cage driving unit almost at the same time when the winding machine is shifted from an acceleration operation to a constant velocity operation, and changes an operating velocity of the inter-cage distance adjustment operation corresponding to a destination floor almost at the same time when the winding machine changes from the constant velocity operation to a deceleration operation after the destination floor is determined, whereby completing the inter-cage distance adjustment operation almost at the same time when the winding machine stops.

2. The double deck elevator according to claim 1, wherein the winding machine controls an acceleration change rate when the winding machine changes from the acceleration operation to the constant velocity operation and from the constant velocity operation to the deceleration operation to be smaller than a case where the cage driving unit does not perform the inter-cage distance adjustment operation.

3. The double deck elevator according to claim 1, wherein the cage driving unit drives one of the upper and lower cages relative to another of the upper and lower cages.

4. The double deck elevator according to claim 1, wherein the cage driving unit drives both of the upper and lower cages.

5. The double deck elevator according to claim 1, further comprising a winding machine control unit which controls the velocity of the cage frame by driving the winding machine, the winding machine control unit comprising the cage position control unit.

6. A double deck elevator comprising:

a winding machine which lifts up/down a cage frame loaded with two cages in a vertical direction;

a cage driving unit which changes a relative distance between upper and lower cages; and a cage position controller which starts an inter-cage distance adjustment operation of the cage driving unit almost at the same time when the winding machine is shifted from an acceleration operation to a constant velocity operation, and keeps an operating velocity of an inter-cage distance adjustment operation at a first velocity when the winding machine is set to the constant velocity operation, and changes the operating velocity of the inter-cage distance adjustment operation at a second velocity almost at the same time when the winding machine changes from the constant velocity operation to a deceleration operation after a destination floor is determined, whereby completing the inter-cage distance adjustment operation almost at the same time when the winding machine stops.

7. The double deck elevator according to claim 6, further comprising:

a memory which stores inter-floor distance information of each floor of a building, and wherein the cage position controller reads out the inter-floor distance information of each stoppable floor from the memory which the cage frame may stop when the winding machine is shifted from the acceleration operation to the constant velocity operation, and calculates the first velocity based on an average of the inter-floor distance information and an average of a time taken until the elevator reaches each stoppable floor.

8. The double deck elevator according to claim 6, further comprising:

a memory which stores inter-floor distance information of each floor of a building, and wherein the cage position controller reads out the inter-floor distance information of each floor from the memory which the cage frame may stop when the winding machine is shifted from the acceleration operation to the constant velocity operation, and calculates the second velocity based on inter-floor distance information corresponding to the destination floor and a time taken until the elevator reaches the destination floor.

9. The double deck elevator according to claim 6, further comprising:

a memory which stores the first velocity and the second velocity for each operation pattern of the cage frame as data table, and wherein the cage position controller reads out the first velocity and the second velocity corresponding to a departure floor and the destination floor of the cage frame so as to control the cage driving unit.

10. The double deck elevator according to claim 6, wherein the cage position controller accelerates the operating velocity of the inter-cage distance adjustment operation unit to the first velocity until the winding machine is shifted from the acceleration operation to the constant velocity operation, and after the destination floor is determined, changes the velocity from the first velocity to the second velocity while the winding machine is shifted from the constant velocity operation to the deceleration operation.

11. The double deck elevator according to claim 6, wherein the winding machine controls an acceleration change rate when the winding machine changes from the acceleration operation to the constant velocity operation and from the constant velocity operation to the deceleration operation to be smaller than a case where the cage driving unit does not perform the inter-cage distance adjustment operation.

12. The double deck elevator according to claim 6, wherein the cage driving unit drives one of the upper and lower cages relative to another of the upper and lower cages.

13. The double deck elevator according to claim 6, wherein the cage driving unit drives both of the upper and lower cages.

14. The double deck elevator according to claim 6, further comprising a winding machine control unit which controls the velocity of the cage frame by driving the winding machine, the winding machine control unit comprising the cage position control unit.

* * * * *